US005158035A

United States Patent [19]

Tanabe

[11] Patent Number: 5,158,035

[45] Date of Patent: Oct. 27, 1992

[54] PORTABLE COLLAPSIBLE BOAT

[75] Inventor: Nobuaki Tanabe, Kamakura, Japan

[73] Assignee: Daimaru Kikou Kabushiki Kaisha, Saitama, Japan

[21] Appl. No.: 415,337

[22] PCT Filed: Feb. 1, 1989

[86] PCT No.: PCT/JP89/00101

§ 371 Date: Sep. 18, 1989

§ 102(e) Date: Sep. 18, 1989

[87] PCT Pub. No.: WO89/07067

PCT Pub. Date: Aug. 10, 1989

[30] Foreign Application Priority Data

Feb. 2, 1988 [JP] Japan ..... 63-22405

[51] Int. Cl.[5] ..... B63B 7/00

[52] U.S. Cl. ..... 114/354; 114/39.1; 114/93; 114/126; 114/353

[58] Field of Search ..... 114/353, 354, 61, 39.1, 114/90, 91, 93, 126

[56] References Cited

U.S. PATENT DOCUMENTS

| | | | |
|---|---|---|---|
| 1,884,792 | 10/1932 | McGrath | 114/354 |
| 2,549,412 | 4/1951 | Bergman | 114/353 |
| 2,600,757 | 6/1952 | Grimston | 114/354 |
| 3,141,435 | 7/1964 | Moffitt | 114/61 |
| 3,383,719 | 5/1938 | Van Der Heide | 114/138 |
| 3,529,312 | 9/1970 | Robinsky | 114/354 |
| 3,577,576 | 5/1971 | Lobb | 114/354 |
| 3,648,309 | 3/1972 | Novakovich | 114/354 |
| 3,748,670 | 7/1973 | Musson | 114/354 |
| 3,984,887 | 10/1976 | Tanemoto | 114/354 |
| 4,161,796 | 7/1979 | Kostanecki | 114/39.1 |
| 4,282,616 | 8/1981 | Battershill | 114/354 |
| 4,416,639 | 11/1983 | Gillmer | 114/39.1 |
| 4,624,208 | 11/1986 | Hyne | 114/345 |

FOREIGN PATENT DOCUMENTS

| | | | |
|---|---|---|---|
| 1062090 | 11/1979 | Canada | 114/354 |
| 57-144181 | 6/1982 | Japan . | |

*Primary Examiner*—Sherman Basinger
*Assistant Examiner*—Thomas J. Brahan
*Attorney, Agent, or Firm*—332n1, Doane, Swecker & Mathis

[57] ABSTRACT

A portable collapsible boat comprises a body formed of a bottom and a pair of sides which are integrally molded with the bottom. The sides are elastically flexible so as to be foldable to horizontal positions overlying the bottom, and unfoldable to upright positions. A bow support plate and a stern support plate can be inserted generally horizontally between upper portions of the sides to retain the sides in their unfolded state. The support plates are pivotably connected to the sides so as to be automatically lowered to positions inside of the boat when the sides are folded, and automatically raised to positions adjacent upper edges of the sides when the sides are unfolded.

18 Claims, 14 Drawing Sheets

PORTABLE COLLAPSIBLE BOAT

FIELD OF THE INVENTION

This invention relates to a portable collapsible boat, the sides of which can be folded or unfolded, and more particularly to a collapsible boat which has improved structure to maintain the unfolded condition of a bow and stern.

BACKGROUND OF THE INVENTION

Referring to U.S. Pat. No. 3,984,887, as one example of a conventional collapsible boat, the right and left sides of the boat can be folded over a bottom of the boat and also can be unfolded back to form a boat shape. The boat has a beam which retains the above-mentioned unfolded condition, and also serves as a seat for occupants.

The overall appearance of the boat body is spindle-shaped with an oval cross section. The body is made of flexible synthetic resins, by blow molding. Right and left sides of the boat are made of flexible material so that they can be folded over the boat bottom and then unfolded. A projection is provided at each inner side of the boat. The beam is installed between the projections to retain the unfolded condition of the sides. The boat has a spindle-shaped hollow shape when the sides are folded over the bottom so that the beam can be stored inside the boat.

In that conventional collapsible boat, the beam and the body are not firmly linked, so the beam may tend to shift in response to vibration. Further it is not easy to unfold and set up the sides from the collapsed condition, because the beam must firstly be taken out from inside the body, and then, while the sides are held in an unfolded condition, the beam must be inserted between the projections. Thus, an awkward setting-up operation constitutes a problem to be solved.

Also, the conventional collapsible boat is structured to be propelled by oars or a motor, not by sails.

There is also a disadvantage in the conventional collapsible boat in that the bow easily rises above the water surface due to its light body weight when using an outboard motor at comparative high speed. That disadvantage is likely to occur when the occupant is seated at the stern of the boat or when the occupant's gear is stored in an improper manner.

An additional disadvantage is that the beam, serving as a seat, must remain at a determined position, so that the occupants cannot move the seat location in order to balance the body. Conversely, if the occupants choose to occupy positions which achieve a proper balance, they may not be able to sit on the seat.

And although certain articles, such as eyelets can, together with the beam be stored, within the boat body, such articles may not be housed in a stable condition, as the housed position of the beam cannot be set at a fixed position.

OBJECTS AND SUMMARY OF PREFERRED EMBODIMENTS OF THE INVENTION

The object of this invention is to provide a portable collapsible boat in which a supporting plate, instead of the conventional beam, is provided at the bow and the stern of the boat and is arranged to be caught between the boat sides for retaining the sides in the unfolded condition; and wherein the supporting plate can be properly housed without being removed from the sides so that smooth assembly can be assured.

A portable collapsible boat of this invention comprises a body in which right and left sides of a boat can be unfolded and folded, and supporting plates retain the boat in the unfolded condition. The body is hollow and blow-molded of flexible synthetic resin, and the supporting plates are removably insertable at both ends of the boat. At the right and left sides of the boat where a supporting plate is provided, plate-retaining brackets are provided having a long hole projecting perpendicularly from the sides. Projections extend from the supporting plates, and are inserted in the long holes.

Accordingly, the supporting plates can be supported in a stable condition within the folded boat and a smooth transfer from the folded condition to the unfolded condition can be achieved.

This invention also provides mast supporting equipment. The bow supporting plate is provided with a hole to receive the mast, and mast supporting equipment is disposed permanently at the bottom of the boat body beneath the above-mentioned hole. The mast supporting equipment comprises a semi-spherically shaped supporting body, having a hole sized to receive the lower end of the mast. The mast can be easily inserted and rotated to achieve a desired sailing operation.

The supporting plate and the mast supporting equipment have notches at the opening ends of the hole. The mast has a projection shaped to pass through the notches of the mast supporting equipment. That projection can be hooked in the opening end of the hole.

A portable collapsible boat according to this invention can also have a pair of floats formed separately of the body and secured to the outer sides of the body. Thus, the floats can be separated from the body for transport.

Also, at the time of installment of the floats, a center board can be inserted through a long hole formed between the body and a float, which eliminates the need to provide a hole in the bottom of the body for receiving the center board.

When propelling the boat at high speed by means of a motor, the boat body can be stabilized by means of flat stabilizers extending between the ends of the floats.

Ridge shaped projections are provided to receive a seat plate which can be easily moved to balance the boat. The seat can be secured against sliding by providing the seat with a plurality of concave and convex grooves at both ends thereof which maximizes friction with the sides of the boat.

Removable equipment to support a mast can also be installed midway between the boat sides after the boat is unfolded.

DETAILED DESCRIPTION OF THE PREFERRED EMBODIMENTS

Figure 1:
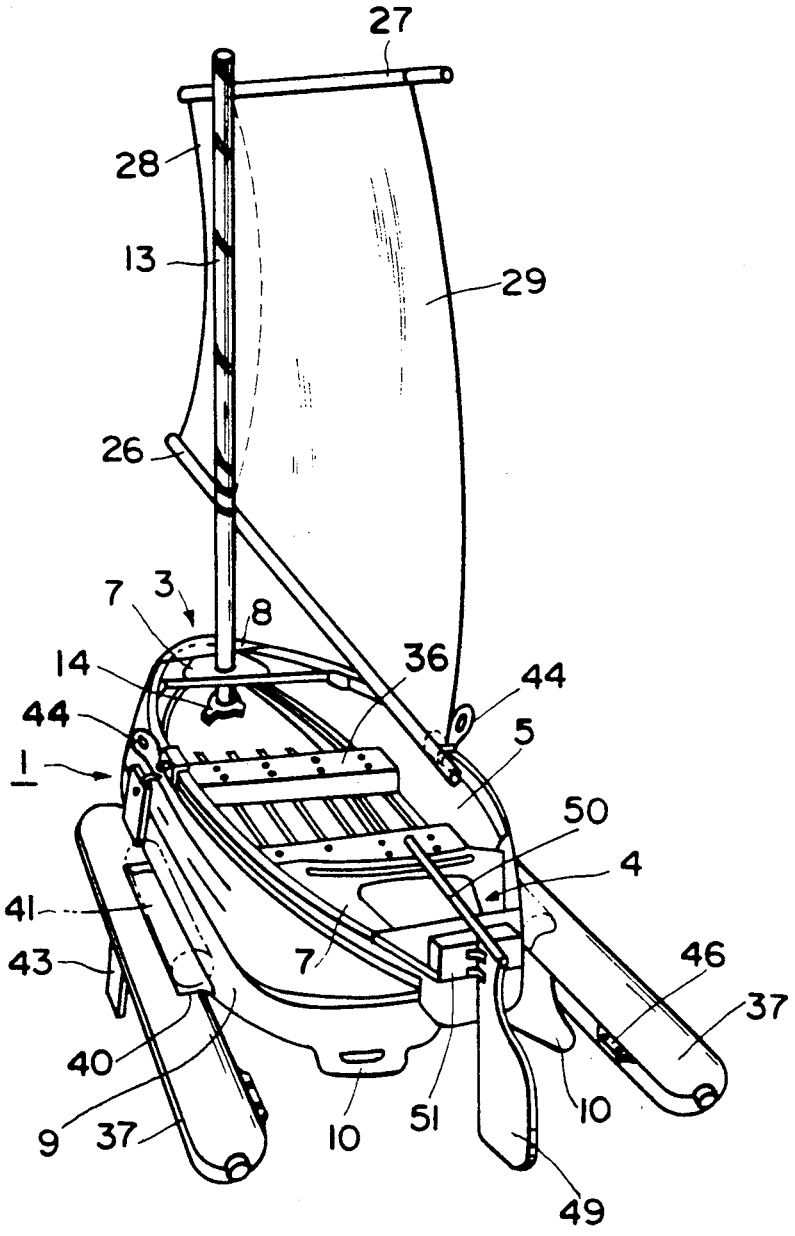
FIG. 1 is a perspective view of a portable collapsible boat according to this invention, in which a mast is set up and sails are hoisted.
Figure 2:
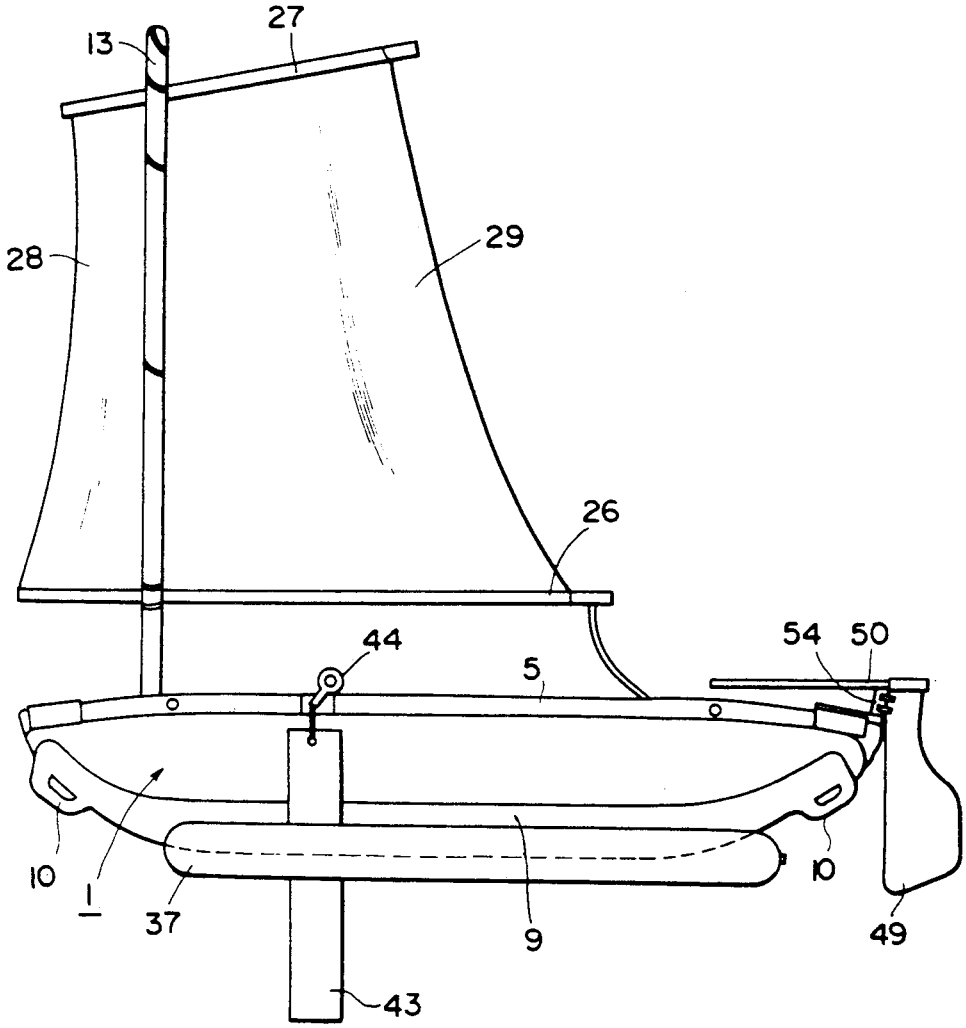
FIG. 2 is a side view of FIG. 1.

A first embodiment of this invention is shown in FIG. 1 through FIG. 21. A body 1 is formed by blow molding using a single hollow mold and is made of a waterproof flexible synthetic resin. As seen in FIGS. 1 and 4, the body is spindle shaped having an oval cross section.

Figure 9:
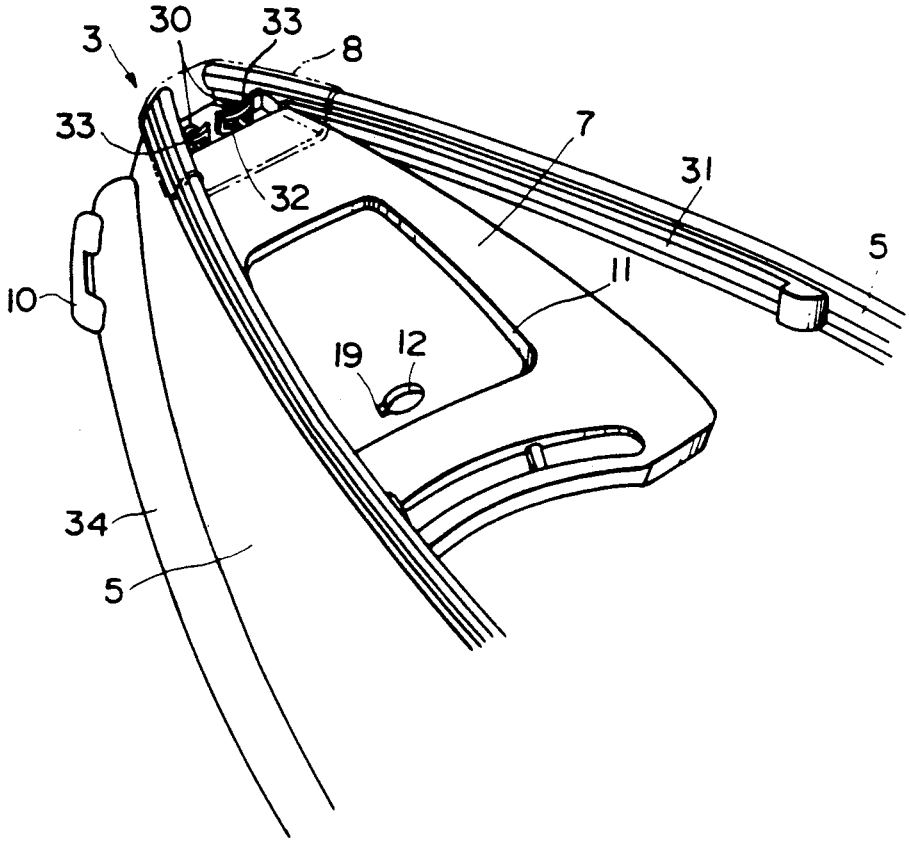
FIG. 9 is a perspective view of the bow as a supporting plate is being removed from its position shown in FIG. 4.
Figure 10:
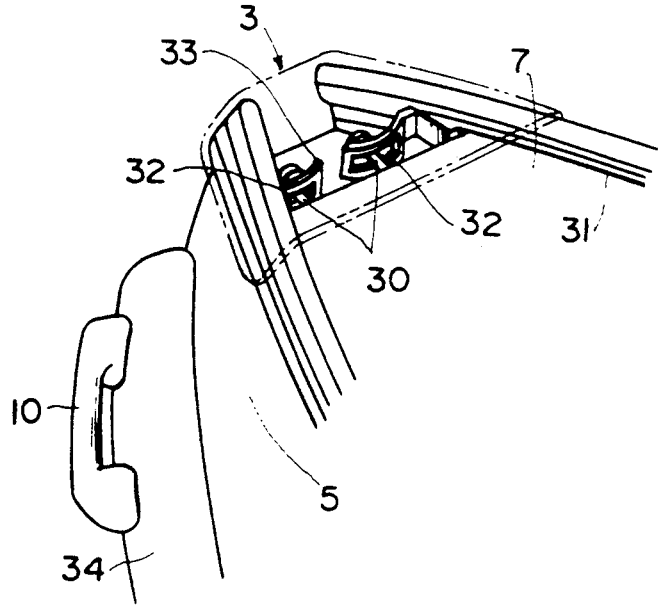
FIG. 10 is a perspective view of the bow with the bow supporting plate installed.

A side opposite the bottom 2 of the body 1 is cut to form a slit 6 extending from a bow 3 to a stern 4 of the body, thereby defining a pair of symmetrical sides 5, 5 lying on opposite sides of the slit 6 (see FIG. 4). The body 1 is unfolded (compare FIGS. 12 and 13) and then held in the unfolded state by the insertion of supporting plates 7, 7' between sides 5, 5 at the bow 3 and stern 4. The bow portion of the body 1 is cut off so as to enable the sides 5, 5 to be folded and unfolded as shown in FIGS. 9-11. Covers 8, 8 of flexible waterproof material are provided to prevent the inflow of water at the bow 3 and stern 4.

Figure 12:
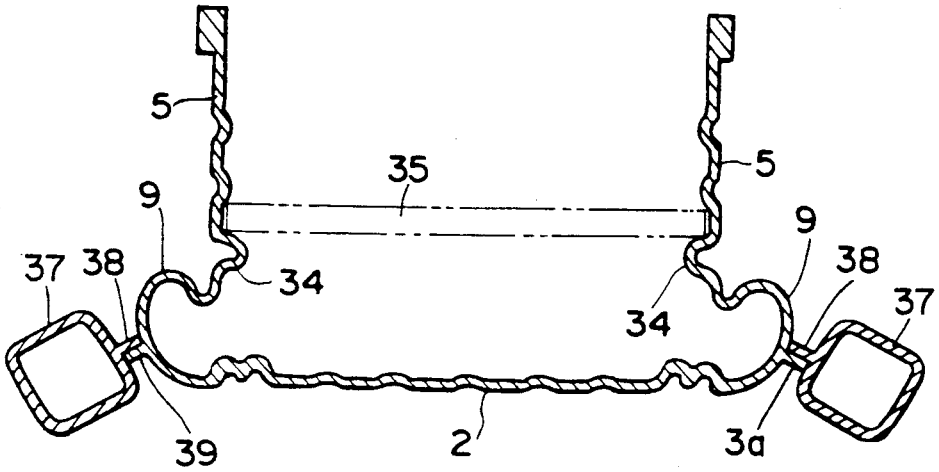
FIG. 12 is a cross section through the boat when in an unfolded condition.
Figure 13:
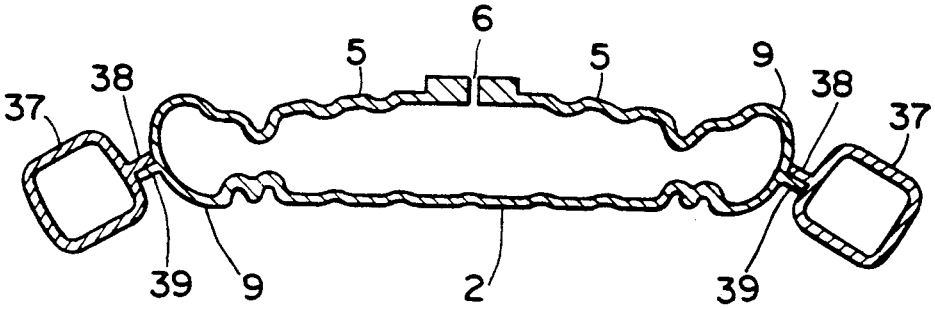
FIG. 13 is a cross section through the boat when in a folded condition.

A curved connection part 9 is disposed between and integral with the bottom 2 and the sides 5 (see FIGS. 12 and 13). That part 9 is thicker than other parts of the body 1 in order to possess enough strength to withstand being flexed during the unfolding of the sides 5, 5. Sides 5, 5 can be unfolded in opposite directions (see FIG. 12) and also can be refolded over the bottom 2 by their own force of restitution (see FIG. 13). Curved connection part 9 possess enough durability and flexibility so that repeated unfolding and folding operations do not damage the body.

A pair of handles are provided at the bottom 2 of the bow 3 and the stern 4 of the body 1. The handles 10 can be used for moving the boat and for receiving ropes.

Each supporting plate 7, 7' is shaped like a trapezoid, and its center portion 11 is formed with a trapezoid-shaped recess 11. The recess 11 can house equipment such as ropes. In the bottom of the recess 11 of bow plate 7, a hole 12 provided to accommodate a mast 13 (see FIGS. 5 and 6).

Figure 5:
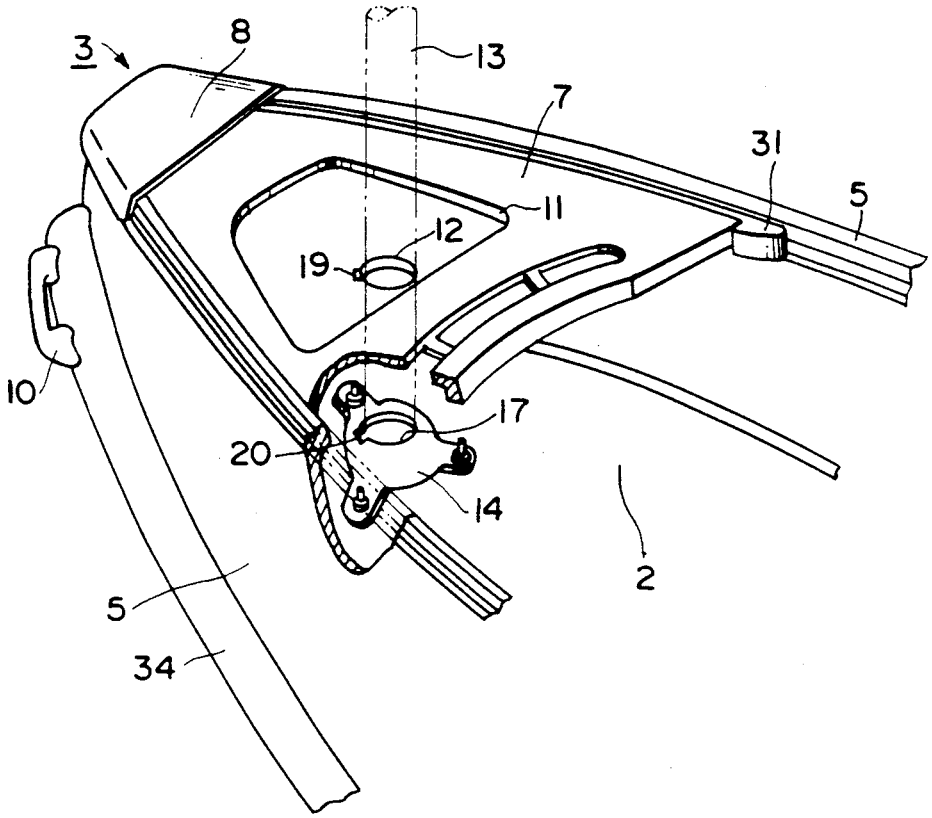
FIG. 5 is an enlarged partially sectioned view, showing the mast provided at the bow supporting plate.
Figure 8:
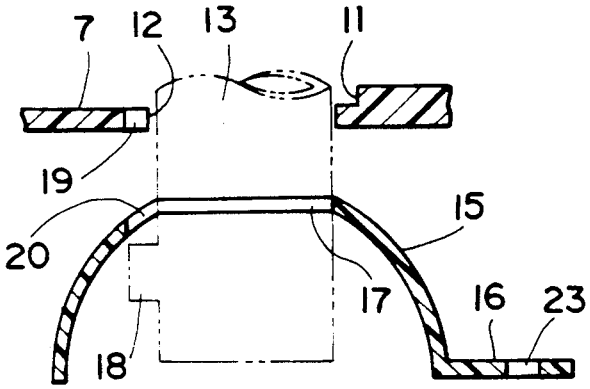
FIG. 8 is an enlarged cross section of the mast supporting equipment taken along the line 8—8 in FIG. 7.

The mast 13 is inserted through the hole 12 of the supporting plate 7 to the bottom 2, and its lower end can be retained by mast supporting equipment 14 mounted on the boat bottom 2. The mast supporting equipment 14, as shown in FIGS. 5 and 8, consists of a supporting body 15 and three fixing pieces 16 projecting from the supporting body 15.

Figure 6:
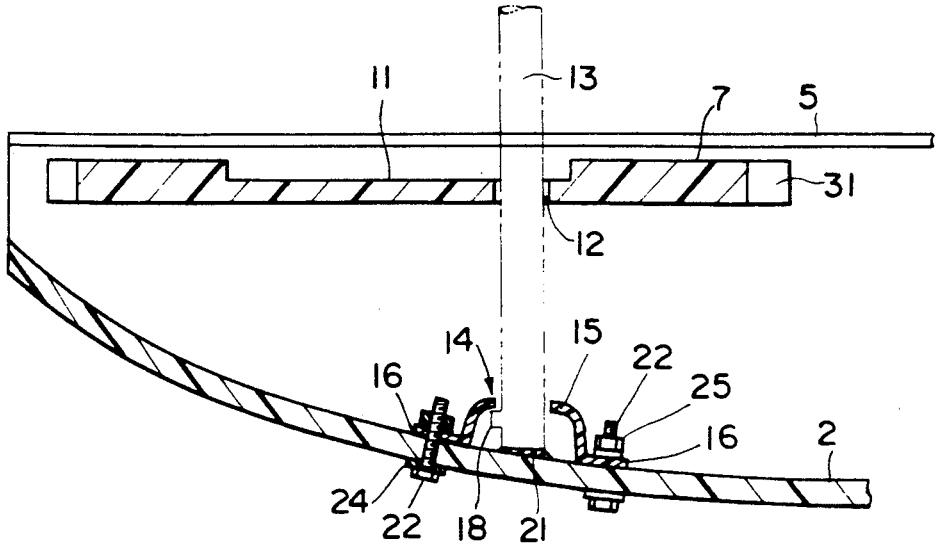
FIG. 6 is an enlarged cross section of the mast supporting part shown in FIG. 5.
Figure 7:
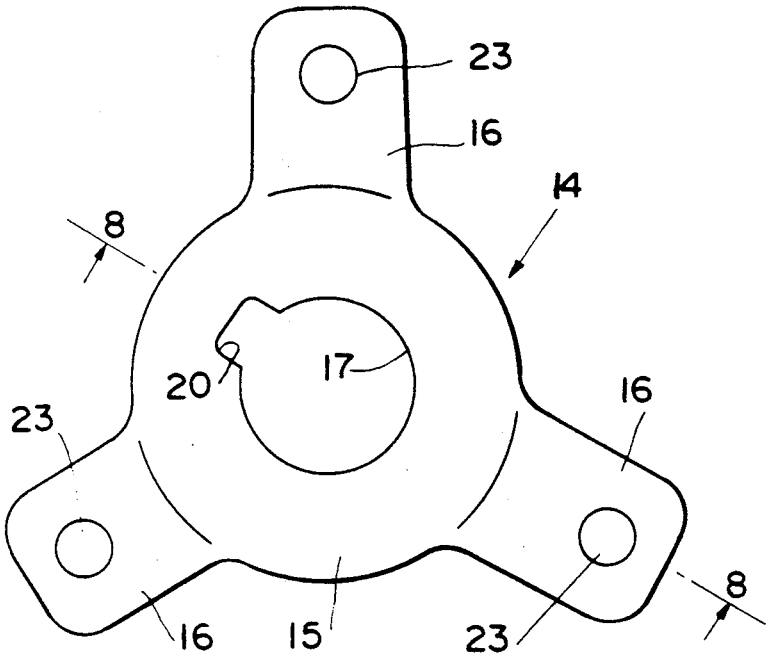
FIG. 7 is an enlarged plan view of mast supporting equipment.

The supporting body 15, which, like the body 1, is made of synthetic resin, has a semi-spherical shaped configuration and its top has a hole 17 for receiving the lower end of the mast 13. The hole 17 is positioned beneath the hole 12 of the supporting plate 7 as shown in FIG. 6, and its diameter is approximately the same as that of the hole 12.

At a fringe of the hole 17 of the supporting body 15 a notch 20 is provided, and at a fringe of the hole 12 of the supporting plate 7 notch 19 is provided through which a projection 18 of the mast 13 can be inserted. The notches 19, 20 are provided to allow one to insert the lower end of mast 13 having the projection 18 (see FIG. 8). After insertion of the lower end of mast 13 into the hole 17 of the supporting body 15, the mast 13 is rotated by a certain angle, which firmly hooks the projection 18 under a fringe of the hole 17. Liner 21 provided at the inner side of the supporting body 15 prevents the lower part of mast 13 from touching directly the bottom 2 (see FIG. 6). Thus the mast 13 can be freely rotated around its axis.

Three installment tabs 16 of the supporting body 15 are fixed to the bottom 2 of the boat 1 by bolts 22 and bolt holes 23. Of course bolt holes are also provided in the bottom 2 of the boat 1. The mast support equipment 14 is fixed on the bottom 2 by bolts 22 which are inserted through a packing 24 from outside of the bottom 2. Bolts 22 are fixed by nuts 25.

The rigging equipment of the boat is a particular type which provides a boom 26 and a yard 27, with a slight angle at the upper part of the mast 13, between which a jib sail 28 and a main sail 29 are equipped together. Various types of rigging, however, can be used for the boat in this invention.

Figure 3:
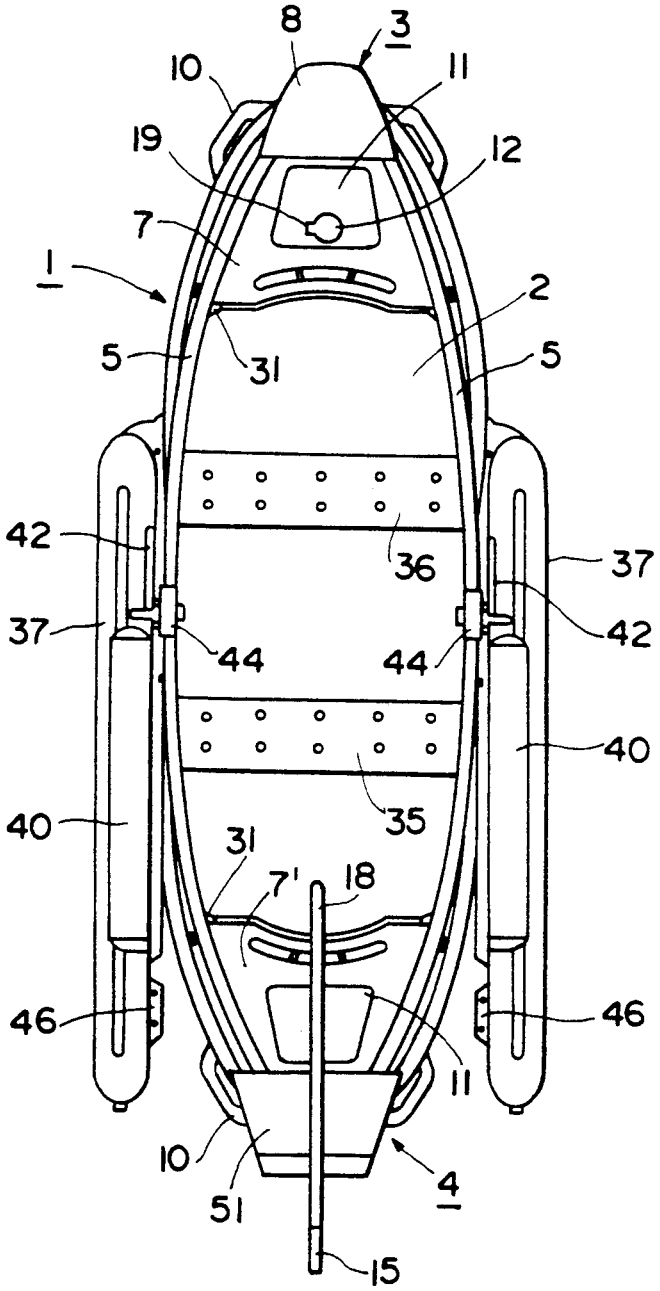
FIG. 3 is a plan view of the boat without the mast and sail shown in FIG. 1.
Figure 4:
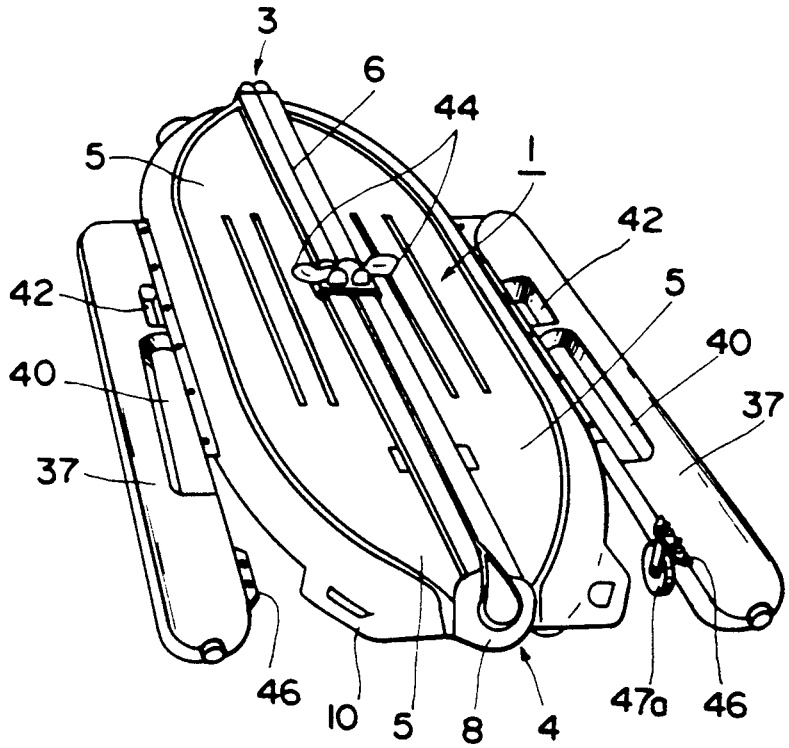
FIG. 4 is a perspective view of the boat in a folded condition.

Each supporting plate 7, 7' is formed of waterproof synthetic resin and possesses side edges which are curved to correspond to the configuration of the unfolded boat sides 5, 5 (see FIG. 3). At each of the bow 3 and stern 4, a pair of installment hooks 30 are provided (as seen from FIGS. 9 and 11B).

A holder 31 is firmly disposed at the upper inner edge of each side 5, 5 for receiving the curved edges of the supporting plates 7, 7'. Each supporting plate 7, 7' is fixed between two holders 31, 31 to retain the sides 5, 5 in an unfolded condition and to form a deck of the bow 3 and stern 4.

At the bow ends of the bow holders 31, and at the stern ends of the stern holders 31, there are provided curved retaining brackets 33 each having a long hole 32 projecting perpendicularly relative to the sides 5, 5.

Installment hooks 30, 30 of the supporting plates 7, 7' are hooked within respective ones of the long holes 32, and the front edge of the supporting plate 7 and rear edge of plate 7' are thus retained by the retaining brackets 33, 33. Each long hole 32 is larger than the inserted installment hook 30, whereby the hooks 30, 30 are pivotably connected to the brackets 33, 33.

Figure 11A:
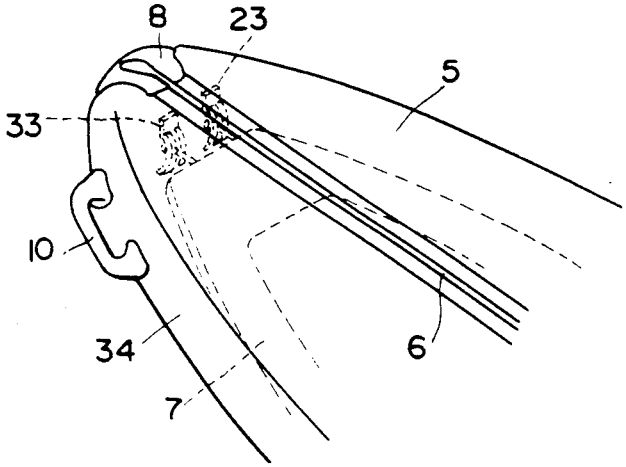
FIG. 11A is a perspective view of the bow when the boat is in a folded condition, and with a bow supporting plate stored inside of the folded boat.
Figure 11B:
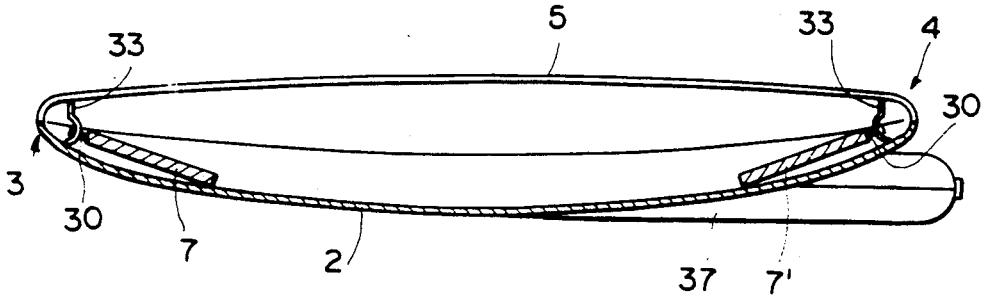
FIG. 11B is a longitudinal sectional view :hrough the boat when in a folded condition.

The retaining brackets 33 rotate with the sides 5, 5 when the sides 5, 5 are folded over the bottom 2 and thus become oriented vertically towards the bottom 2 as shown in FIGS. 11A and 11B. That rotation of the brackets 33 occurs relative to the supporting plates 7, 7' which remain generally horizontal and become housed within a space formed by the bottom 2 and the sides 5, 5.

Inward projections 34 are formed on sides 5, 5 and extend from the bow 3 to the stern 4. Between those ridge-like projections 34, seats 35 can be supported (see FIGS. 12 and 15). The seat 35 is made of the same waterproof synthetic resin as the body 1.

Figure 14:
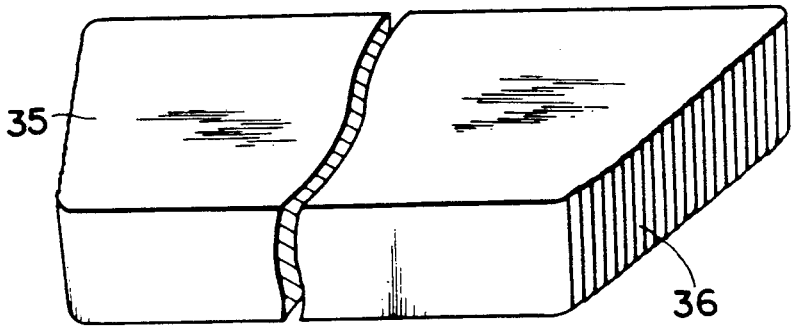
FIG. 14 is an enlarged perspective view of a seat plate.
Figure 15:
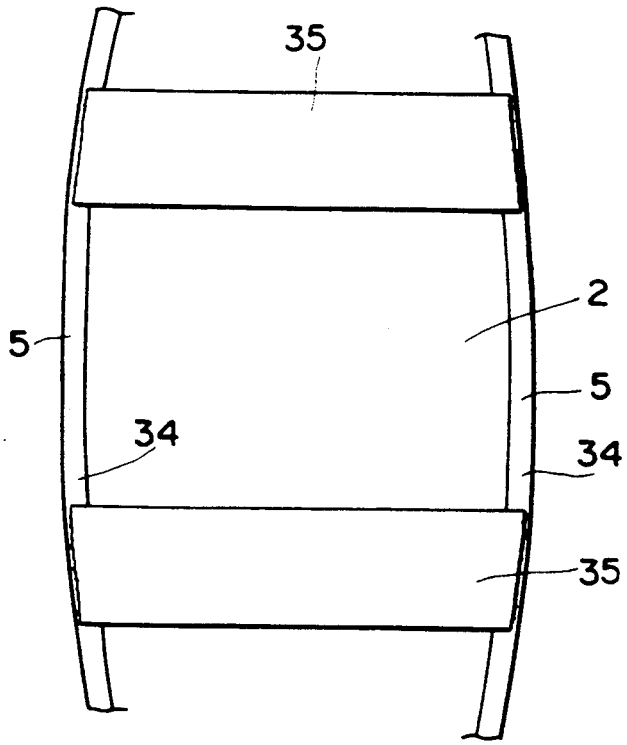
FIG. 15 is a fragmentary plan view of the boat depicting two seat plates.

The seat 35 is formed to be trapezoidal by tapering both ends of a plate as seen in FIGS. 14 and 15. At the tapered ends, a plurality of concave and convex grooves 36 are formed. The seat 35 is structured to be moved freely towards the bow 3 or the stern 4 by being slid along the projections 34, 34. Where the spacing between sides 5, 5 becomes narrow (see FIG. 15), the seats 35 become frictionally wedged between the sides 5, 5 to retain their position.

At the sides 5, 5, two floats 37 are provided (see FIG. 12). Each floats 37 is of square cross section and is fixed to a projection 39 extending outwardly from the connection part 9 of the body 1. The float 37, like the body 1, is made of a resin, and water or other ballast is contained therein to balance the light weight body 1.

A recess 40 is formed at the center part of each float 37 (see FIG. 4). This recess 40 is provided to house an oxygen tank 41 for skin diving (see FIG. 1). Forwardly of recess 40, a hole 42 is formed in which a center board 43 can be inserted (see FIG. 1) so as to project into the water when sailing. Center board 43 is fixed to an eye 44 at a side 5, and a lower part of each float 37 is provided with reinforcing ribs 45 (see FIG. 20).

The floats 37 hang downwardly when the body 1 is not floating on water. When the body 1 is floating on water the floats 37 rotate upwardly and assume a horizontal orientation, due to the buoyancy of the water.

Figure 17:
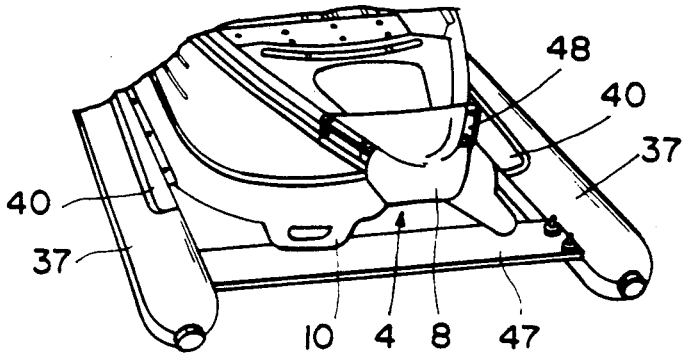
FIG. 17 is a perspective view of the stern, showing a stabilizer mounted at the stern ends of the floats.
Figure 18:
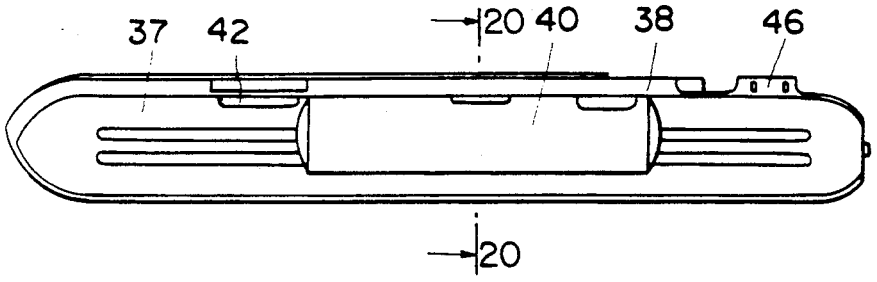
FIG. 18 is a plan view of a float.
Figure 19:
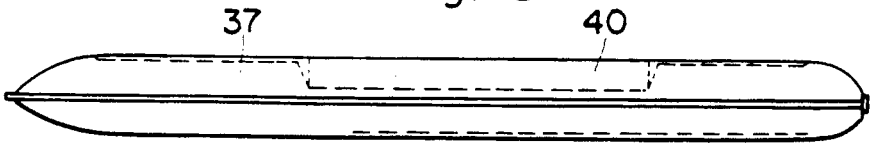
FIG. 19 is a side view of a float.
Figure 20:
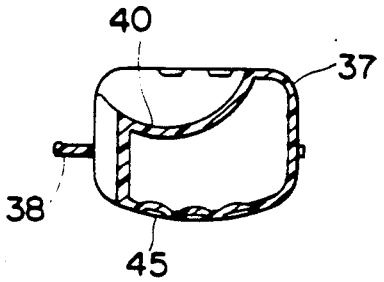
FIG. 20 is a cross section taken along the line 20—20 of FIG. 18.
Figure 21:
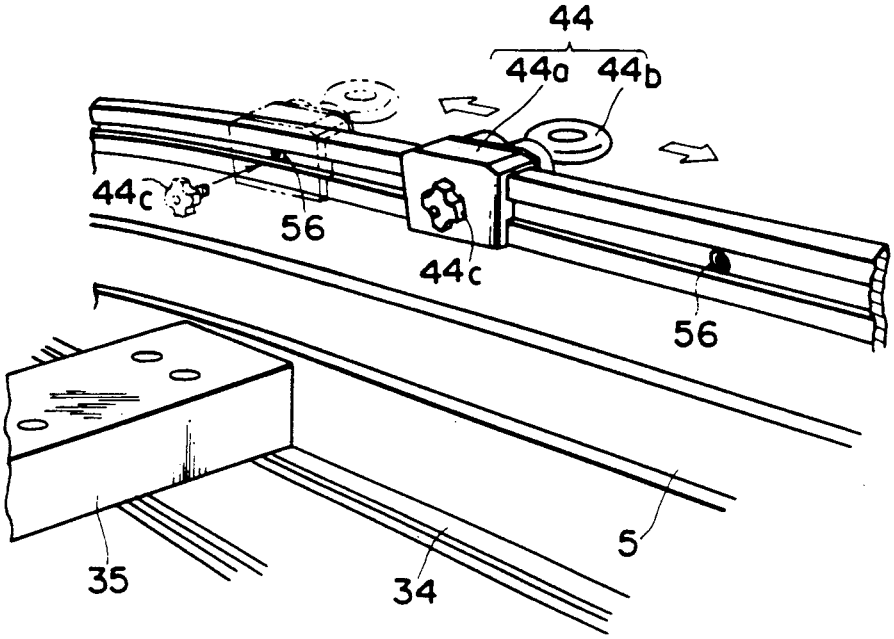
FIG. 21 is an enlarged perspective view showing various positions of an eye clutch provided at a side of the boat.

Between projections 46, 46 provided at the stern side of the floats 37, a flat stabilizer 47 can be attached (see FIG. 17). In place of the stabilizer 47, a caster **47*a* could be provided for convenience when moving or handling by hand (see FIG. 4**).

Figure 16:
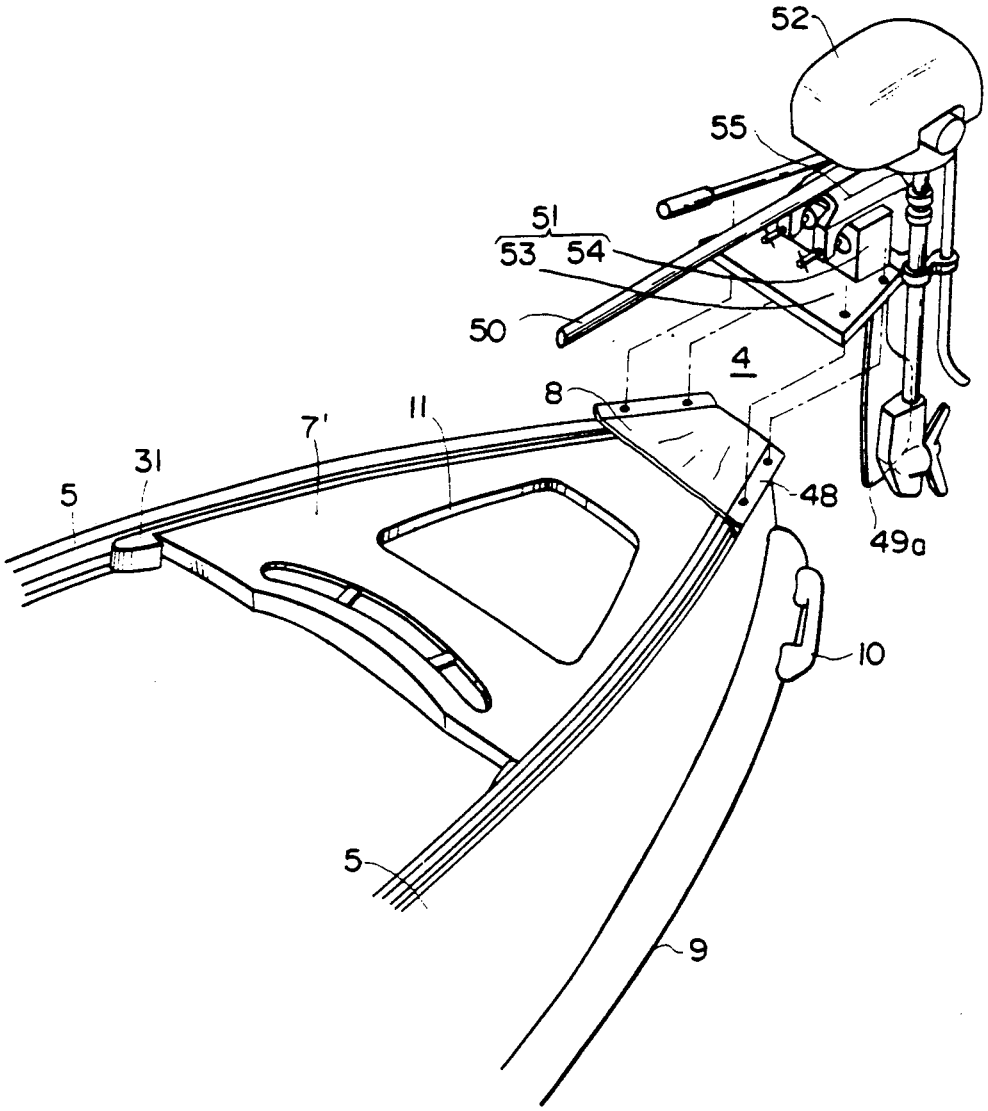
FIG. 16 is an exploded perspective view of the stern of the boat, showing a rudder, and an outboard motor mounted on the stern supporting plate.

At the stern side of the sides 5, 5 the cover 8 provides flanges 48 (see FIG. 16). To equip a rudder 49 and a tiller 50, a mounting plate 51 is fastened onto the flanges 48. Also an outboard motor 52 can be mounted on the mounting plate 51.

The mounting plate 51 carries a rudder 49 and a block 54 for installment of the outboard motor 52 at the stern side of a plate 53. Outboard motor 52 is equipped with a hook 55 for connection with the block 54. Tiller 50 is installed at the upper end of the rudder 49 and projects above the supporting plate 7 of the body 1 so that its movement is not obstructed. Bolt holes 56 (FIG. 21) are also formed at different points at upper ends of the sides 5, 5 to enable the position of clutches 44 to be changed. Eyes of the clutches **44*b* rotate freely on a U-shaped base 44*a*. Base 44*a* is fixed to a side 5, and set screw 44*c* is screwed in the bolt hole 56**.

The assembly of the boat is achieved as follows, starting from a folded state of the sides 5, 5. The sides 5, 5 are unfolded (FIG. 12) and at that time care must be taken that sides 5, 5 shall not be refolded due to their inherent force of restitution by inserting the plates 7, 7' between holders 31, 31. Forces of restitution of the sides 5,5 are resisted by the supporting plates 7, 7' and thus the assembly is completed.

When folding the boat, one can slightly separate the sides 5, 5 to enable the supporting plates 7, 7' to be removed from the holders 31, 31. Upon removal of the supporting plates 7, 7' the sides 5, 5 are folded over the bottom 2 by their force of restitution.

Figure 23:
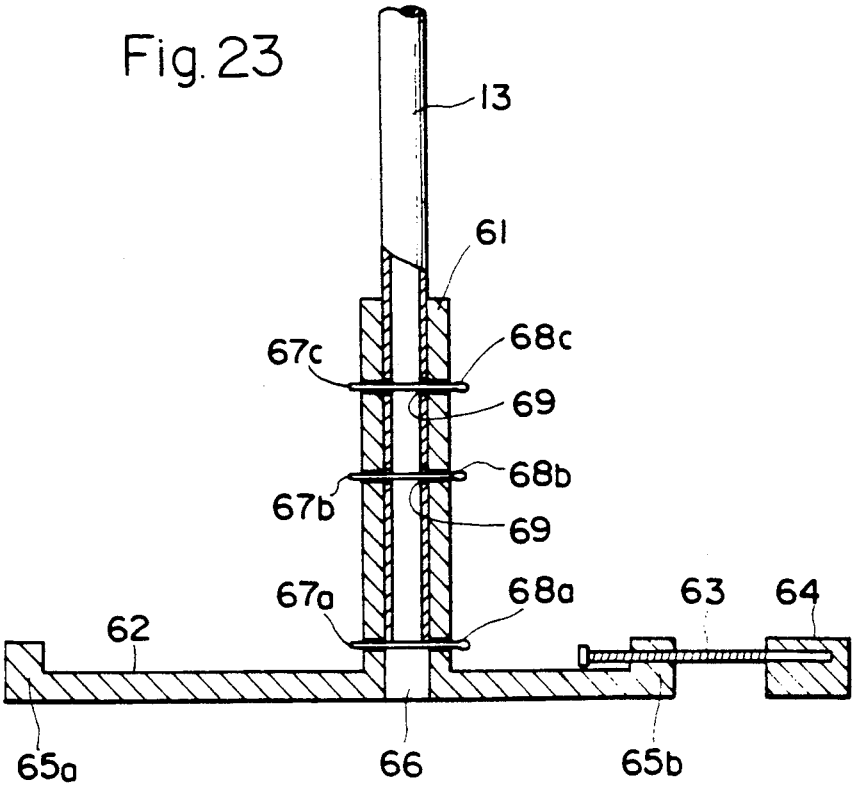
FIG. 23 is a vertical cross section through the mast supporting equipment depicted in FIG. 22.
Figure 22:
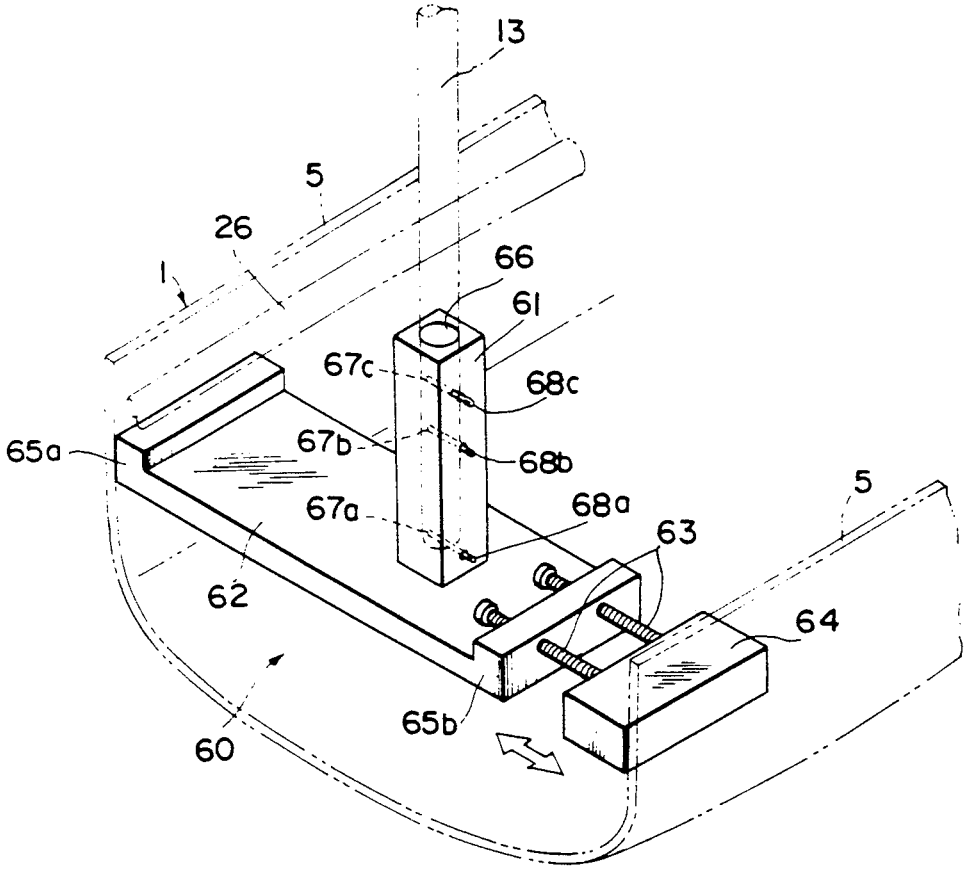
FIG. 22 is a perspective view of a second embodiment of mast supporting equipment according to the invention.

Another preferred embodiment will be explained hereinafter referring to FIGS. 22 and 23.

Mast supporting body 60 consists of a base 62 which carries a supporting tube 61 for the mast 13. A movable body 64 is connected by two bolts 63, 63 to the base 62.

Base 62 comprises a flat plate with projections **65*a*, 65*b* at both of its ends. At a center of the plate, the supporting tube 61 is provided. The distance between each of the projections 65*a*, 65*b* and the supporting tube 61 equals the distance between the center of the body 1, and a respective side 5. Body 64 is movable so that the space between the projection 65*b* and the body 64 can be changed. Upon unfolding the body 1 the base 62 can be positioned at the center of the body 1. By rotating the bolts 63, the base 62 can be secured between the sides 5, 5**.

The supporting tube 61 is a square shaped tube, and formed with a vertical hole 66. Three pin holes **67*a*, 67*b*, 67*c* are formed in the tube 61. Pin 68*a* inserted into the lowest pin hole 67*a* supports lower end of the mast 13, and the mast 13 is fixed by the pins 68*b*, 68*c* inserted into the remaining pin holes 67*b* and 67*c*. At the lower end of the mast 13, holes 69, 69 are formed at positions coinciding with the pin holes 67*b* and 67*c***.

To set the mast 13, the pin **68*a* is inserted in the pin hole 67*a* at the lowest part of the supporting tube 61. Mast body 60 is located at the center part of the body 1. Bolts 63 are rotated to separate the movable body 64 from the base 62 to make the projection 65*a* and the movable body 64 engage the sides 5, 5. This enables the supporting tube 61 of the mast 13 to be located at the center of the body 1**.

The lower end of the mast 13 is inserted into the hole 66 of the supporting tube 61, and the pins **68*b*, 68*c* are inserted in the pin holes 67*b*, 67*c* and the pin holds 69, 69 of the mast 13, and the mast 13** is then fixed.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A portable collapsible boat, comprising a body which includes a generally horizontal bottom and a pair of sides projecting from opposite edges of said bottom; said bottom and sides being integrally molded of a flexible synthetic resin wherein said sides are flexible relative to said bottom and capable of being folded to generally horizontal positions over said bottom and unfolded to generally upright positions; a bow support plate located at a bow end of said body; a stern support plate located at a stern end of said body; each of said support plates being positionable in a generally horizontal orientation between upper portions of said sides to retain said sides in their unfolded condition; connecting means for pivotably connecting said bow and stern support plates to said sides for lowering said bow and stern support plates to lowered positions within said boat when said sides are folded, and for raising said bow and stern support plates to raised positions located adjacent said upper portions of each sides when said sides are unfolded; said sides including holding means for holding said support plates in their raised positions, said connecting means comprising a first pair of retaining brackets projecting perpendicularly inwardly from bow ends of respective ones of said sides, and a second pair of retaining brackets projecting perpendicularly inwardly from stern ends of respective ones of said sides, each bracket including an elongated hole, said bow support plate including hooks extending through said holes to define pivot connections between said support plates and said sides.

2. A portable collapsible boat according to claim 1, wherein said holding means comprise holders extending along upper portions of said sides at bow and stern ends thereof; said bow and stern support plates being connectable to said holders.

3. A portable collapsible boat according to claim 1, wherein said bow support plate includes a hole for receiving a mast, said bottom including mast supporting means located beneath said hole.

4. A portable collapsible boat according to claim 3, wherein said mast supporting means comprises a support body attached to said bottom and including a mast-receiving hole aligned with said hole in said bow support plate.

5. A portable collapsible boat according to claim 4, wherein each of said holes includes a notch for receiving a projection of a mast.

6. A portable collapsible boat according to claim 1 including a pair of floats releasably attached to respective ones of said sides.

7. A portable collapsible boat according to claim 6, wherein said floats include vertical holes for receiving center boards.

8. A portable collapsible boat according to claim 7 including a generally horizontal stabilizer removably extending between said floats at stern ends thereof.

9. A portable collapsible boat according to claim 8, wherein said floats include projections for receiving ends of said stabilizer, said projections adapted to receive wheels for facilitating movement of the boat on land.

10. A portable collapsible boat according to claim 1, wherein eyes are mounted to upper edges of said sides, said eyes being forwardly and rearwardly adjustable.

11. A portable collapsible boat according to claim 1, wherein said sides include inwardly projecting ridges, and generally horizontal seat plates removably mounted on said ridges between said support plates.

12. A portable collapsible boat according to claim 11, wherein said seat plates are of trapezoidal shape when viewed in plan.

13. A portable collapsible boat according to claim 12, wherein opposite edges of each seat plate include projections for frictionally engaging said sides.

14. A portable collapsible boat according to claim 1 including a mounting plate removably mounted above said stern support plate for receiving a rudder.

15. A portable collapsible boat according to claim 1 including mast supporting means comprising a base, an upright mast-receiving tube carried by said base, and a movable body mounted at one end of said base by adjustable means enabling said base and movable body to be separated from one another so that said base engages one of said sides while said movable body engages the other of said sides.

16. A portable collapsible boat, comprising a body which includes a generally horizontal bottom and a pair of sides projecting from opposite edges of said bottom; said bottom and sides being integrally molded of a flexible synthetic resin wherein said sides are flexible relative to said bottom and capable of being folded to generally horizontal positions over said bottom and unfolded to generally upright positions; a bow support plate located at a bow end of said body; a stern support plate located at a stern end of said body; each of said support plates being positionable in a generally horizontal orientation between upper portions of said sides to retain said sides in their unfolded condition; connecting means for connecting said bow and stern support plates to said sides for lowering said bow and stern support plates to lowered positions within said boat when said sides are folded, and for raising said bow and stern support plates to raised positions located adjacent said upper portions of said sides when said sides are unfolded; said sides including holding means for holding said support plates in their raised positions, said bow support plate including a hole for receiving a mast, said bottom including mast supporting means located beneath said hole, said mast supporting means comprising a support body attached to said bottom and including a mast-receiving hole aligned with said hole in said bow support plate, each of said holes including a notch for receiving a projection of a mast.

17. A portable collapsible boat, comprising a body which includes a generally horizontal bottom and a pair of sides projecting from opposite edges of said bottom; said bottom and sides being integrally molded of a flexible synthetic resin wherein said sides are flexible relative to said bottom and capable of being folded to generally horizontal positions over said bottom and unfolded to generally upright positions; a bow support plate located at a bow end of said body; a stern support plate located at a stern end of said body; each of said support plates being positionable in a generally horizontal orientation between upper portions of said sides to retain said sides in their unfolded condition; connecting means for connecting said bow and stern support plates to said sides for lowering said bow and stern support plates to lowered positions within said boat when said sides are folded, and for raising said bow and stern support pates to raised positions located adjacent said upper portions of said sides when said sides are unfolded; said sides including holding means for holding said support plates in their raised positions; and a pair of floats releasably attached to respective ones of said sides, said floats including vertical holes for receiving center boards.

18. A portable collapsible boat, comprising a body which includes a generally horizontal bottom and a pair of sides projecting from opposite edges of said bottom; said bottom and sides being integrally molded of a flexible synthetic resin wherein said sides are flexible relative to said bottom and capable of being folded to generally horizontal positions over said bottom and unfolded to generally upright positions; a bow support plate located at a bow end of said body; a stern support plate located at a stern end of said body; each of said support plates being positionable in a generally horizontal orientation between upper portions of said sides to retain said sides in their unfolded condition; connecting means for connecting said bow and stern support plates to said sides for lowering said bow and stern support plates to lowered positions within said boat when said sides are folded, and for raising said bow and stern support pates to raised positions located adjacent said upper portions of said sides when said sides are unfolded; said sides including holding means for holding said support plates in their raised positions, a pair of floats releasably attached to respective ones of said sides; and a generally horizontal stabilizer removably extending between said floats at stern ends thereof.

* * * * *